United States Patent [19]

Sakurai et al.

[11] Patent Number: 4,646,610

[45] Date of Patent: Mar. 3, 1987

[54] ELECTRONIC MUSICAL INSTRUMENT WITH AUTOMATIC ENDING ACCOMPANIMENT FUNCTION

[75] Inventors: Keiichi Sakurai; Takehiko Kayahara, both of Tokyo, Japan

[73] Assignee: Casio Computer Co., Ltd., Tokyo, Japan

[21] Appl. No.: 784,698

[22] Filed: Oct. 3, 1985

Related U.S. Application Data

[63] Continuation of Ser. No. 598,508, Apr. 9, 1984, abandoned.

[30] Foreign Application Priority Data

| | | | |
|---|---|---|---|
| Apr. 18, 1983 | [JP] | Japan | 58-67060 |
| Apr. 21, 1983 | [JP] | Japan | 58-69211 |
| Apr. 21, 1983 | [JP] | Japan | 58-69212 |

[51] Int. Cl.[4] ..... G10F 1/00

[52] U.S. Cl. ..... 84/1.03; 84/DIG. 12

[58] Field of Search ..... 84/1.01, 1.03, 1.24, 84/DIG. 12

[56] References Cited

U.S. PATENT DOCUMENTS

| | | | |
|---|---|---|---|
| 4,089,245 | 5/1978 | Dietrich | 84/1.03 |
| 4,256,005 | 3/1981 | Mishima | 84/1.03 |
| 4,299,154 | 11/1981 | Dietrich et al. | 84/1.03 |
| 4,357,854 | 11/1982 | Hirano | 84/1.03 |
| 4,412,471 | 11/1983 | Stier et al. | 84/1.03 |

FOREIGN PATENT DOCUMENTS 2414773 3/1974 Fed. Rep. of Germany .

*Primary Examiner*—Forester W. Isen

*Attorney, Agent, or Firm*—Frishauf, Holtz, Goodman & Woodward

[57] ABSTRACT

When an ending switch is operated on an electronic musical instrument while an automatic accompaniment is being produced, the pattern data of an automatic ending accompaniment is read out from a memory. Corresponding accompaniment sounds are generated from a loudspeaker to obtain the automatic ending.

34 Claims, 19 Drawing Figures

FIG. 2A

| ADDRESS | RHYTHM SOUND | | | | | | |
|---|---|---|---|---|---|---|---|
| | CY | HH | CL | HC | LC | SD | BD |
| 0 | 1 | 1 | 0 | 0 | 0 | 0 | 1 |
| 1 | 0 | 1 | 0 | 0 | 0 | 1 | 0 |
| 2 | 1 | 1 | 0 | 0 | 0 | 0 | 1 |
| 3 | 0 | 1 | 0 | 0 | 0 | 1 | 0 |
| 4 | 1 | 1 | 0 | 0 | 0 | 0 | 1 |
| 5 | 0 | 1 | 0 | 0 | 0 | 1 | 0 |
| 6 | 1 | 1 | 0 | 0 | 0 | 0 | 1 |
| 7 | 0 | 1 | 0 | 0 | 0 | 1 | 0 |

FIG. 2B

| ADDRESS | RHYTHM SOUND | | | | | | |
|---|---|---|---|---|---|---|---|
| | CY | HH | CL | HC | LC | SD | BD |
| 0 | 1 | 1 | 0 | 0 | 0 | 1 | 1 |
| 1 | 1 | 0 | 0 | 0 | 0 | 1 | 0 |
| 2 | 0 | 0 | 0 | 0 | 0 | 1 | 1 |
| 3 | 1 | 0 | 0 | 0 | 0 | 1 | 0 |
| 4 | 1 | 0 | 0 | 0 | 0 | 1 | 0 |
| 5 | 0 | 0 | 0 | 0 | 0 | 0 | 0 |
| 6 | 1 | 1 | 0 | 0 | 0 | 1 | 1 |
| 7 | 0 | 0 | 0 | 0 | 0 | 0 | 0 |

| ADDR. \ RHY. | CY | HH | SD | BD |
|---|---|---|---|---|
| 0 | 1 | 1 | 0 | 1 |
| 1 | 0 | 1 | 1 | 0 |
| 2 | 1 | 1 | 0 | 1 |
| 3 | 0 | 1 | 1 | 0 |
| 4 | 1 | 1 | 0 | 1 |
| 5 | 0 | 1 | 1 | 0 |
| 6 | 1 | 1 | 0 | 1 |
| 7 | 0 | 1 | 1 | 0 |

| ADDR. \ RHY. | CY | HH | SD | BD |
|---|---|---|---|---|
| 0 | 1 | 0 | 1 | 1 |
| 1 | 1 | 0 | 1 | 0 |
| 2 | 0 | 0 | 1 | 1 |
| 3 | 1 | 0 | 1 | 0 |
| 4 | 1 | 1 | 1 | 1 |
| 5 | 0 | 0 | 0 | 0 |
| 6 | 0 | 0 | 0 | 0 |
| 7 | 0 | 0 | 0 | 0 |

| ADDR. \ RHY. | CY | HH | SD | BD |
|---|---|---|---|---|
| 0 | 1 | 1 | 0 | 1 |
| 1 | 0 | 1 | 1 | 0 |
| 2 | 1 | 1 | 0 | 1 |
| 3 | 0 | 1 | 1 | 0 |
| 4 | 1 | 1 | 0 | 1 |
| 5 | 0 | 1 | 1 | 0 |
| 6 | 1 | 1 | 0 | 1 |
| 7 | 0 | 1 | 1 | 0 |

| ADDR. \ RHY. | CY | HH | SD | BD |
|---|---|---|---|---|
| 0 | 1 | 1 | 1 | 1 |
| 1 | 1 | 0 | 1 | 0 |
| 2 | 0 | 0 | 1 | 1 |
| 3 | 1 | 0 | 1 | 0 |
| 4 | 1 | 0 | 1 | 0 |
| 5 | 0 | 0 | 0 | 0 |
| 6 | 1 | 1 | 1 | 0 |
| 7 | 0 | 0 | 0 | 0 |

| ADDR. \ RHY. | CY | HH | SD | BD |
|---|---|---|---|---|
| 0 | 1 | 1 | 1 | 0 |
| 1 | 1 | 1 | 1 | 0 |
| 2 | 1 | 1 | 1 | 0 |
| 3 | 1 | 0 | 1 | 1 |
| 4 | 1 | 1 | 1 | 0 |
| 5 | 1 | 1 | 1 | 0 |
| 6 | 1 | 1 | 1 | 0 |
| 7 | 1 | 0 | 1 | 1 |

ELECTRONIC MUSICAL INSTRUMENT WITH AUTOMATIC ENDING ACCOMPANIMENT FUNCTION

This application is a continuation of application Ser. No. 598,508, filed Apr. 9, 1984, now abandoned.

BACKGROUND OF THE INVENTION

The present invention relates to an electronic musical instrument having an automatic accompaniment function.

Various types of electronic musical instruments having an automatic accompaniment function for automatically performing rhythm sounds on the basis of a rhythm pattern data stored in advance, have been recently developed so as to achieve a variety of performance capability. The instruments of such type are constructed to generate rhythm sounds by employing a rhythm pattern designation signal for a rock, a march or a waltz selected, for example, by means of a rhythm pattern switch for accessing a rhythm pattern memory, and supplying the read out rhythm pattern data to a rhythm source circuit. When stopping the production of such rhythm accompaniment sounds, the supply of the rhythm pattern data to the rhythm source circuit is interrupted. However, since the generated rhythm sounds are abruptly stopped, listeners tend to feel uncomfortable, resulting in a large drawback in the automatic accompaniment.

SUMMARY OF THE INVENTION

It is an object of the present invention to provide an electronic musical instrument having an automatic ending accompaniment function capable of stopping an automatic accompaniment always to provide a natural and smooth feeling.

According to the present invention, there is provided an electric musical instrument which comprises means for generating data for an automatic ordinary accompaniment; means for outputting the instruction signal of the execution of an automatic ending accompaniment when the automatic ordinary accompaniment is carried out according to the automatic ordinary accompaniment data; and means responsive to the designation signal of the execution of the automatic ending accompaniment for generating the automatic ending accompaniment data instead of the automatic ordinary accompaniment data.

BRIEF DESCRIPTION OF THE DRAWINGS

FIG. 2A and FIG. 2B are respectively views showing the contents of rhythm pattern data stored in a memory in FIG. 1;

DETAILED DESCRIPTION OF THE PREFERRED EMBODIMENTS

Figure 1:
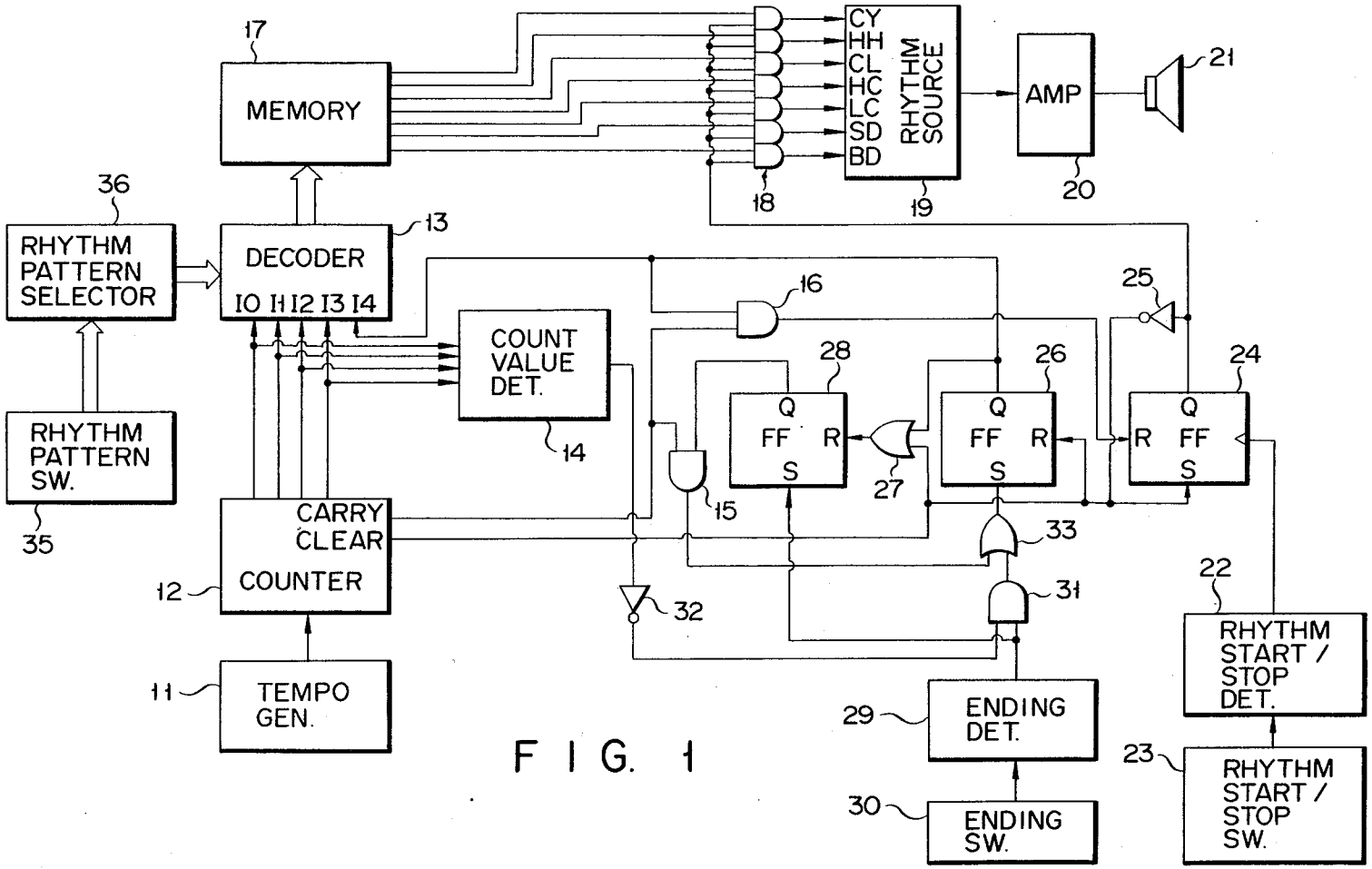
FIG. 1 is a block diagram showing an embodiment of an electronic musical instrument according to the present invention.

A first embodiment will be described with respect to the case that an ordinary accompaniment pattern and an ending accompaniment pattern are switched as to the rhythm pattern of a march. In FIG. 1, a tempo generator 11 delivers a clock pulse, the oscillating frequency of which can be controlled by a tempo control knob (not shown), to a counter 12. The counter 12 repeatedly counts in an octal notation from "0000" to "0111" on the basis of the clock pulse from the generator 11, delivers the count value through four output lines to terminals $I_0$, $I_1$, $I_2$, $I_3$ of a decoder 13 and also to a count value detector 14. The carry output of the octal counter 12 is inputted to AND gates 15 and 16.

The decoder 13 sequentially designates addresses 0 to 7 of two memory sections of a memory 17 formed of a ROM (Read-Only-Memory) storing the data of the ordinary accompaniment pattern or ending accompaniment pattern of the rhythm sounds of the march on the basis of the count value. When "1" ("high" state of binary logic levels) is applied to the terminal $I_4$, an address designation is switched from the memory section of the ordinary pattern to the memory section of the ending pattern.

The ordinary rhythm pattern and the ending pattern of the march in the memory 17 will be described with reference to FIG. 2A and FIG. 2B. Data "0" which indicates non sound production ("low state" of binary logic levels) or data "1" which indicates a sound production ("high state" of binary logic levels) is stored in each of areas designated for a cymbal (CY), a high hat (HH), a claves (CL), a high conga (HC), a low conga (LC), a snare drum (SD) and a bass drum (BD) in response to each address of 0 to 7. The respective rhythm pattern data from the cymbal to the bass drum can be read out in parallel by addressing by the decoder 13.

Figure 3A:
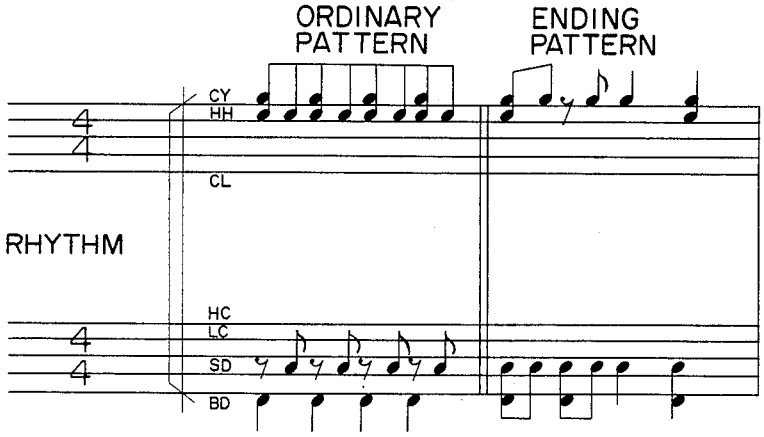
FIG. 3A to FIG. 3D are respectively views showing the performance patterns of rhythm sounds in music scores.

The rhythm pattern data of the ordinary pattern and the ending pattern which are respectively read out from the two memory sections of the memory 17 are inputted through AND gate group 18 to a rhythm source 19, which can, in turn, generate rhythm sound signals of seven types from the above-described cymbal to the bass drum, which are then amplified through an amplifier 20, whereby the respective rhythm sounds are sounded from a loudspeaker 21 in rhythm pattern as shown in FIG. 3A.

A rhythm start/stop detector 22 is composed, for example, of a one-shot circuit and serves to detect the ON operation of a rhythm start/stop switch 23 and to produce one pulse "1" to the clock terminal of a flip-flop 24. The flip-flop 24 applies its output Q to the AND gate group 18 to control the opening or closing of the AND gate group 18, and further applies the output Q through an inverter 25 to its own S(set) terminal so that the output Q is inverted whenever an input "1" is inputted to the clock terminal thereof. The output Q of the flip-flop 24 fed through the inverter 25 is applied to the R (reset) terminal of a flip-flop 26, and also applied to the R terminal of a flip-flop 28 through an OR gate 27 and to the clear terminal of the above-described counter 12.

Further, an ending detector 29 is composed, for example, of a one-shot circuit and serves to detect the ON operation of an ending switch 30 and to produce one pulse "1" to an AND gate 31 and the S terminal of the flip-flop 28 to control or switch the flip-flop 28. To the AND gate 31 is also supplied with an output from the count value detector 14 through an inverter 32. The detector 14 outputs "1" when the count value supplied from the counter 12 becomes higher than "0101(5)" to close the AND gate 31.

The output of the AND gate 31 is, in turn, supplied through an OR gate 33 to the S terminal of the flip-flop 26. The Q output "1" of the flip-flop 26 is applied to the terminal $I_4$ of the above-described decoder 13, which controls the addressing of the memory 17 from the ordinary pattern section to the ending pattern section. The Q output of flip-flop 26 is also applied to the AND gate 16, and to the R terminal of the flip-flop 28 through the OR gate 27.

The output Q of the flip-flop 28 is inputted to the AND gate 15, which applies its output to the S terminal of the flip-flop 26 through the OR gate 33 to control or switch the flip-flop 26.

The output of the AND gate 16 is supplied to the R terminal of the flip-flop 24.

An operation of the embodiment constructed as described above will now be described.

When the power source switch (not shown) is first turned-on and a suitable tempo is selected by the tempo control knob (not shown), the tempo generator 11 is activated.

Figure 4:
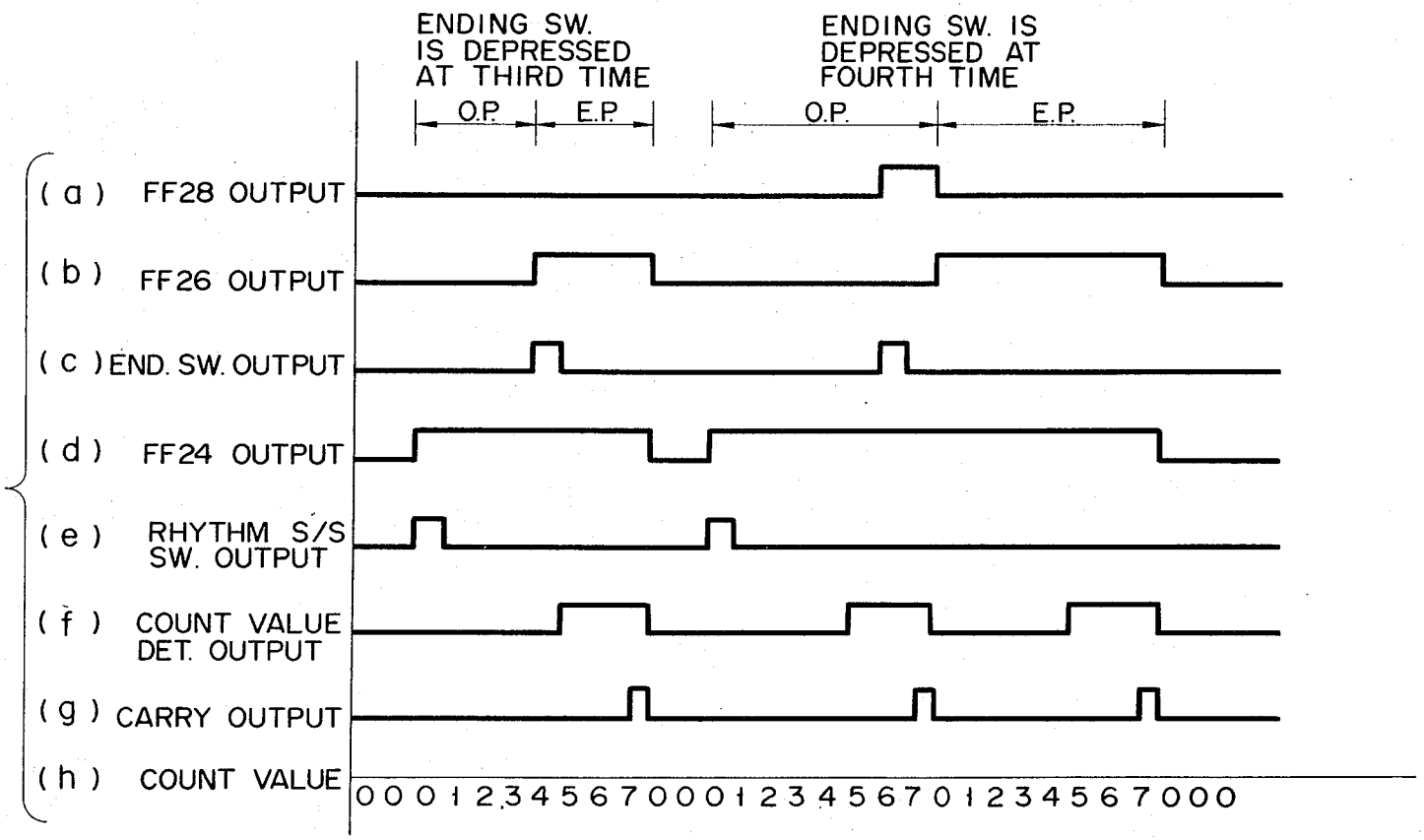
FIG. 4 is a time chart showing the operation of the embodiment in FIG. 1.

When the rhythm start/stop switch 23 is then turned ON, a one pulse "1" is applied to the clock terminal of the flip-flop 24 from the rhythm start/stop detector 22 as shown in FIG. 4(*e*). Since the Q output of the flip-flop 24 is "0" so far and "1" is then applied through the inverter 25 to the S terminal of the flip-flop 24, the Q output is switched to "1" as shown in FIG. 4(*d*) to open the AND gate group 18.

Thus, the output of the inverter 25 is switched from "1" to "0". Then, the reset states of the flip-flops 26, 28 are released, and the clear state of the counter 12 is also released. Then, the counter 12 is driven by the clock pulse from the tempo generator 11, and the count value is sequentially supplied to the decoder 13. Since the flip-flop 26 is reset, "0" is applied to the terminal $I_4$ of the decoder 13. Accordingly, the decoder 13 addresses the memory section of the ordinary pattern in the memory 17, reads out the ordinary rhythm pattern data from the addresses from 0 to 7, which is, in turn, inputted to the rhythm source 19 through the AND gate 18 opened as described above, and the rhythm sound of the pattern as shown in FIG. 3B is sequentially produced and irradiated from the loudspeaker 21, and repeated in every one measure.

Figure 3B:
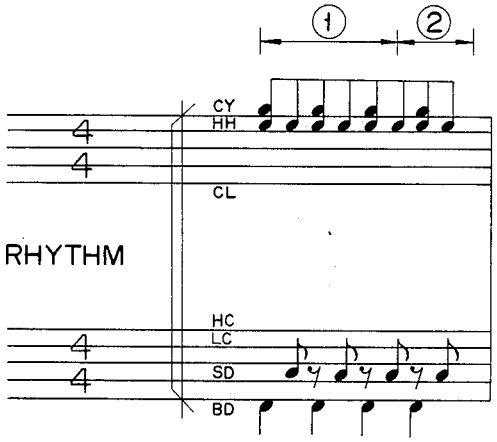

Assume now that the ending switch 30 is operated at the third time from the first time to the third time as designated by 1 in FIG. 3B. Then, a one pulse "1" is applied from the ending detector 29 to the AND gate 31. Since the count value of the counter 12 is 4 at this time, the count value detector 14 does not produce an output, and the AND gate 31 remains open. Accordingly, a one pulse "1" from the detector 29 is inputted through the AND gate 31 and the OR gate 33 to the S terminal of the flip-flop 26.

Then, the output Q of the flip-flop 26 becomes "1" as shown in FIG. 4(*b*), "1" is applied to the terminal $I_4$ of the decoder 13, the addressing of the memory 17 is switched to the other memory section, and the decoder 13 then reads out the ending pattern data to immediately switch the rhythm sound produced and irradiated from the ordinary pattern to the ending pattern.

Figure 3C:
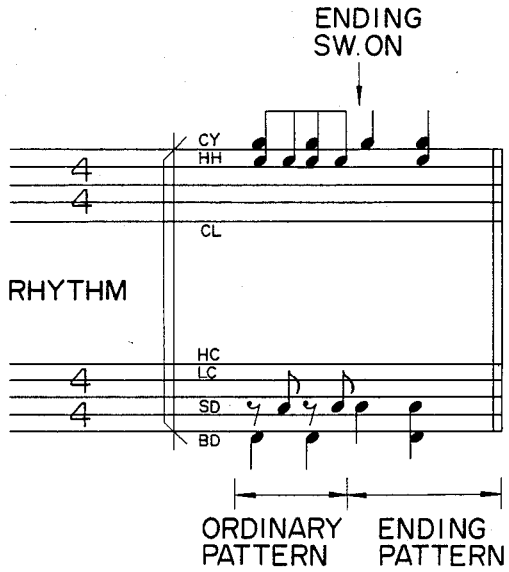

In this case, since the counter 12 counts the count value 4 and subsequently counts 5, 6, . . . the addresses 0, 1, 2 and 3 of the memory section for the ordinary pattern of the memory 17 are first designated and then addresses 4, 5, 6, . . . of the memory section of the ending pattern are designated, thus performing the rhythm of the final measure in the pattern as shown in FIG. 3C.

When the count value of the counter 12 becomes 7 so that the carry output becomes "1", the AND gate 16 is opened by the Q output "1" of the flip-flop 26. Thus, the carry output "1" is inputted through the AND gate 16 to the R terminal of the flip-flop 24. Then, the Q output of the fliP-flop 24 becomes "0" to close the AND gate group 18 to stop the production of the rhythm sound, and the output of the inverter 25 becomes "1". Consequently, it resets the flip-flops 26, 27, and clears the counter 12.

In this manner, the rhythm sound is generated and finished with the ending pattern.

Subsequently, assume that the ending switch 30 is operated at the fourth time from the third and one-third time to the last as designated by 2 in FIG. 3C while the rhythm sound of the ordinary pattern is being produced and generated. Then, a one pulse "1" is applied from the ending detector 29 to the AND gate 31 in the same manner as described above. The count value of the counter 12 is 6 at this time, the count value detector 14 produces an output as shown in FIG. 4(*f*), and the AND gate 31 is closed. Therefore, the AND gate 31 does not produce an output. Thus, the flip-flop 26 is not set, and the decoder 13 does not switch to the ending pattern section at this time.

Further, the one pulse "1" from the ending detector 29 is also applied to the S terminal of the flip-flop 28 to set the flip-flop 28 as shown in FIG. 4(*a*), the Q output "1" thereof being applied to the AND gate 15 to open the same. When the rhythm sound in one measure of the ordinary pattern is completely generated, the count value of the counter 12 becomes 7, and the carry output "1" is applied through the AND gate 15 opened as described above and the OR gate 33 to the S terminal of the flip-flop 26.

Then, the output Q of the flip-flop 26 becomes "1" in the same manner as described above, the decoder 13 switches the addressing output to alter the rhythm sounds from the ordinary pattern to the ending pattern, and resets the flip-flop 28.

Figure 3D:
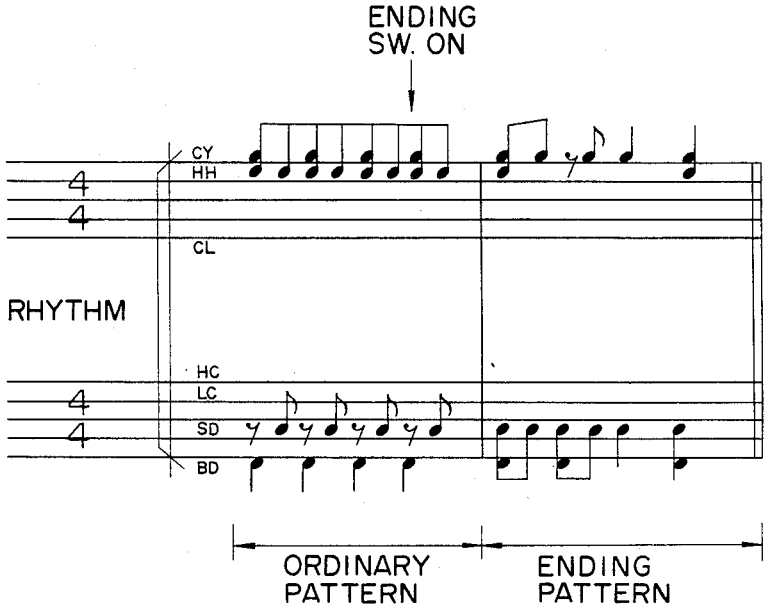

In this case, since the counter 12 has delivered the carry output, the decoder 13 sequentially addresses the memory section of the ending pattern of the memory 17 from 0 stepwisely. Thus, the ending pattern sounds are produced in one measure from its first tone, and the rhythm performance is eventually carried out in the pattern in FIG. 3D.

When the count value of the counter 12 becomes 7 and the counter 12 then produces the carry output "1", the flip-flop 24 is reset in the same manner as described above to close the AND gate 18, thereby stopping the production and generation of the rhythm sounds, and the flip-flops 26, 28 are reset, and the counter 12 is cleared.

In this manner, when the ending switch 30 is operated in the vicinity of the end of the ordinary pattern of the rhythm sound, the ordinary pattern is first finished in one measure, and the ending pattern is performed entirely in one measure. Therefore, the possibility that the ending pattern is generated for an extremely short period of time is eliminated, thereby obtaining the finishing feeling appropriate for the ending.

In the embodiment described above, the memory 17 stores the ordinary pattern data and the ending pattern data only for a march. However, the memory 17 may additionally store data for a rock, a samba or a waltz. In this case, a rhythm pattern switch 35 is connected through a rhythm pattern selector 36 to the decoder 13, and the rhythm pattern data may be selected by the operation of the switch 35.

Further, in the embodiment described above, the ending performance is achieved for the rhythm sounds of the march. However, the ending pattern may be carried out for the accompaniment of chords, bass, or arpeggio, and they may be combined in the ending pattern.

According to the present invention as described above, the automatic ending accompaniment can be carried out instead of the automatic ordinary accompaniment by the operation of the ending means. Therefore, the ending of the automatic accompaniment can be finished with the ending appropriate for the ending with a smooth ending feeling, with the result that the expression of the automatic accompaniment can be enhanced and with easiness of employing the automatic accompaniment.

Figure 5:
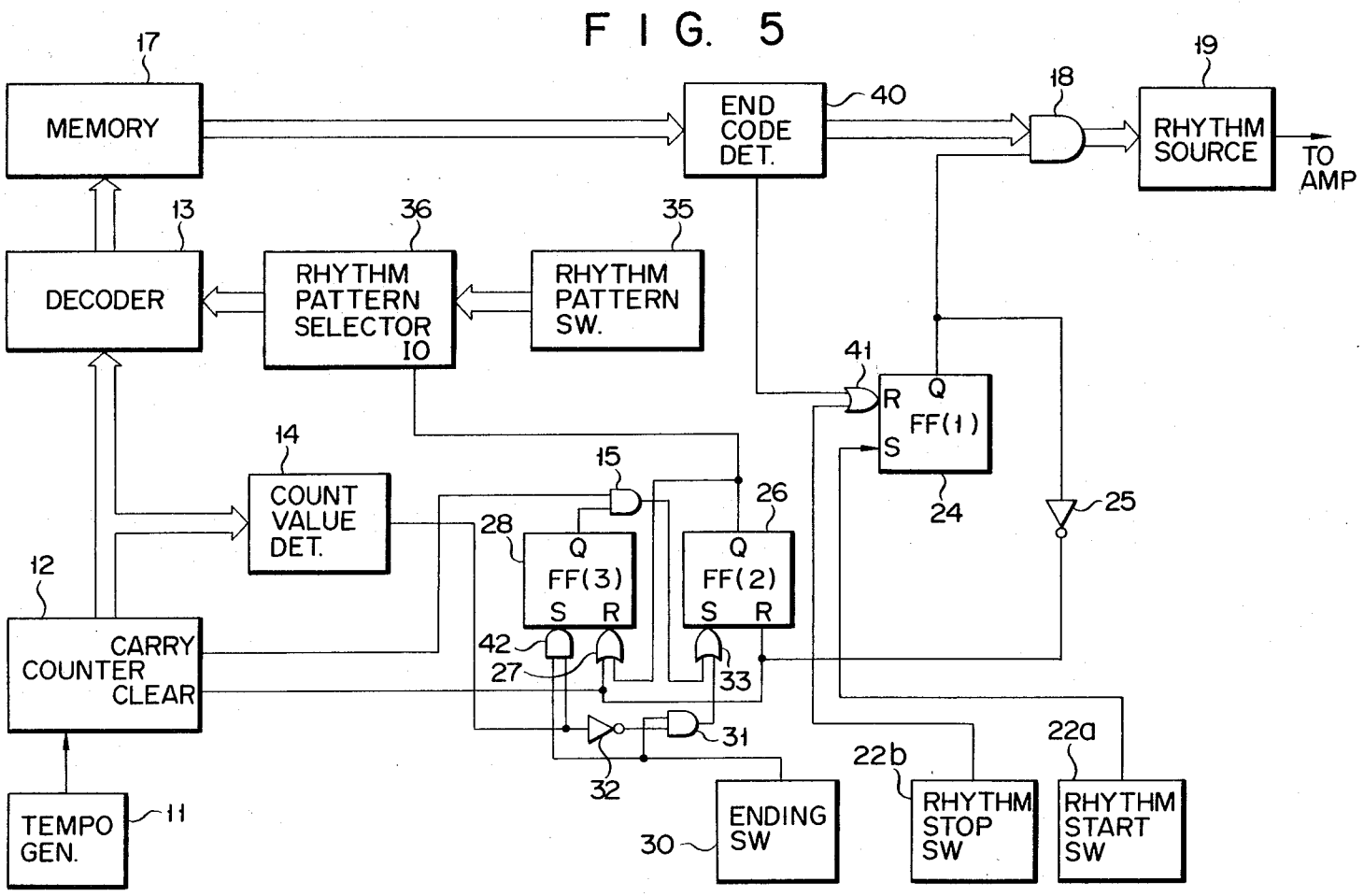
FIG. 5 is a block diagram of another embodiment of an electronic musical instrument according to the present invention.

Referring now to FIG. 5, another embodiment of the electronic musical instrument with an automatic ending accompaniment function will be described. The same reference numerals as in the first embodiment denote the same parts in the second embodiment of FIG. 5, and will be omitted in detailed description. In FIG. 5, an output data of a memory 17 is supplied through an end code detector 40 to an AND gate 18. When the outputs from the memory 17 are all "1", a signal "1" is outputted from the detector 40, and supplied to the reset terminal R of the flip-flop 24 through an OR gate 41. An output of a rhythm stop switch **22*b* is supplied also through the OR gate 41 to the reset terminal R thereof. An output of a rhythm start switch 22*a* is supplied to the set terminal S of the flip-flop 24**.

When a signal "1" is applied from the flip-flop 26 to the terminal $I_0$ of a rhythm pattern selector 36, the selector 36 applies ending switching data to a decoder 13.

The decoder 13 addresses 0 to 7 for the ordinary pattern or the ending pattern with respect to a rhythm such as a march or a rock stored in the memory 17 on the basis of the count value from the counter 12, further addresses the rhythm such as a march or a rock on the basis of the data from the rhythm pattern selector 36 and switches the addresses for the ordinary pattern, the ending pattern or the final pattern.

The output of the ending switch 30 is supplied to the AND gate 31 and also to an AND gate 42. The output of the count value detector 14 is supplied to the other input terminal of the AND gate 42, and the output of the AND gate 42 is supplied to the set input terminal of the flip-flop 28. The remaining circuit arrangement is constructed in the same manner as that in FIG. 1.

The operation of the embodiment shown in FIG. 5 will now be described.

Figure 8:
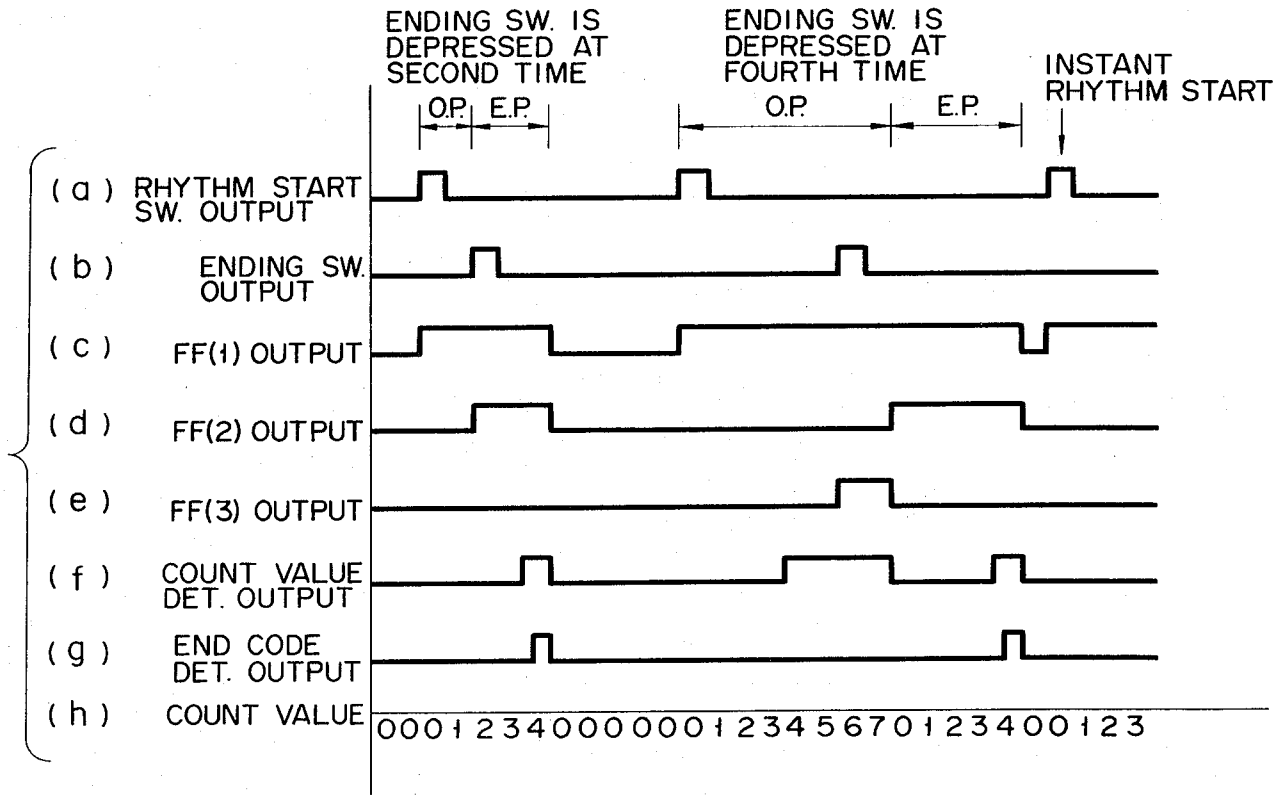
FIG. 8 is a time chart for describing the operation of the embodiment in FIG. 5.

When the rhythm start switch **22*a* is turned ON, the flip-flop 24 is set as shown in FIG. 8**(*c*), the AND gate 18 is opened by the Q output "1", the reset states of the flip-flops 26, 28 are released through the inverter 25, and the clear state of the counter 12 is also released.

Thus, the counter 12 is driven by a clock pulse from the tempo generator 11, and the count values 0 to 7 are sequentially supplied to the decoder 13. If the rhythm of the march is selected by the rhythm pattern switch 35, its ON operation is detected by the rhythm pattern selector 36, and the data is supplied to the decoder 13. Since the flip-flop 26 is reset, "0" is applied to the terminal $I_0$ of the selector 36, and the data of the ordinary pattern is applied to the decoder 13.

Thus, the decoder 13 addresses the ordinary pattern section for the march in the memory 17 on the basis of these data and the count value. If an address 0 is designated, only the area of snare drum SD is "0" but the other areas are "1". Accordingly, the snare drum sound is at a rest in response to the address, and the other sounds are generated in the denoted rhythm pattern. In this manner, the rhythm pattern data of the addresses from 0 to 7 are sequentially and repeatedly read out, and inputted through the AND gate 18 opened as described above to the rhythm source 19. The corresponding rhythm sounds are generated in the ordinary pattern as shown in FIG. 6, and repeated in each measure.

Figures 6, 7A, 7B:
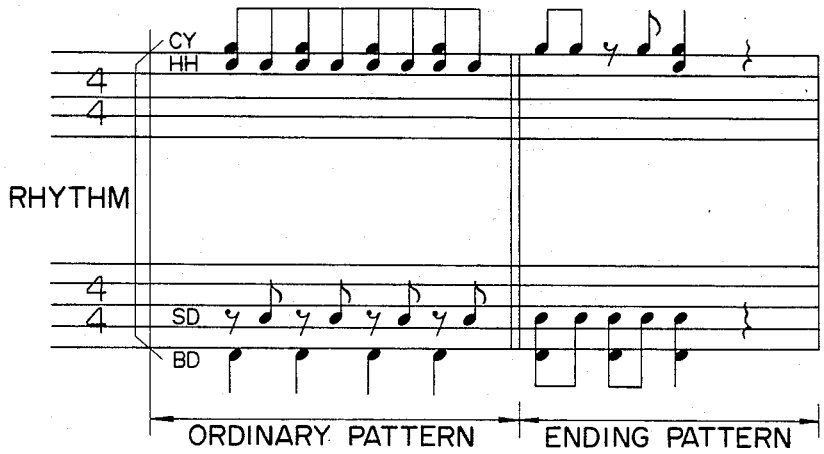
FIG. 6 is a view showing part of the music score for describing the operation of the embodiment in FIG. 5.
FIG. 7A and FIG. 7B are respectively views showing the contents of rhythm pattern data stored in a memory in FIG. 5.

Assume now that the ending switch 30 is operated at the second time from the first time to the second and one-half time as shown in FIG. 6. Since the count value of the counter 12 is "2" at this time, the count value detector 14 does not output, the AND gate 42 is closed, and the AND gate 31 is opened. Therefore, a one pulse "1" from the ending switch 30 sets the flip-flop 26 through the OR gate 33 and the AND gate 31 as shown in FIG. 8.

Then, the Q output "1" of the flip-flop 26 is inputted to the terminal $I_0$ of the rhythm pattern selector 36, an ending switching data is applied from the selector 36 to the decoder 13 to switch the address of the memory 17 by the decoder 13 for reading out the ending pattern data as shown in FIG. 6, and the rhythm sounds are switched immediately from the ordinary pattern to the ending pattern.

In this case, the counter 12 is not cleared after its contents become the count value "2", but subsequently continues counting "3, 4, . . . ". Therefore, the decoder 13 addresses, after 0 and 1 of the ordinary pattern section in the memory 17, to advance to 2, 3, . . . of the ending pattern section.

When decoder 13 has read out the all areas "1" of the address 4 of the ending pattern section and allowed the corresponding rhythm sounds to be generated, an end code detector 40 detects the final sound as shown in FIG. 8 to reset the flip-flop 24 through an OR gate 41. Then, the AND gate 18 is closed, the flip-flops 26, 28 are reset through the inverter 25, and the counter 12 is cleared to finish the automatic accompaniment.

In this case, the fact that all the areas from the cymbal to the bass drum are "1" is detected as final sound data. This is because an ending feeling can normally be provided by generating almost all the musical instruments as the final sounds.

In this manner, the automatic accompaniment has finished while the last rest of the ending pattern remains, and the automatic accompaniment can be immediately started again without waiting for the lapse of the last rest.

Assume now this time that the ending switch 30 is operated at the fourth time after the third time of the ordinary pattern while the rhythm sounds of the ordinary pattern are being generated. At this time, the count value of the counter 12 is "6", and the count value detector 14 produces an output "1" as shown in FIG. 8. Accordingly, an AND gate 42 is opened, one pulse "1" from an ending switch 30 sets a flip-flop 28 though the AND gate 42 as shown in FIG. 5, and an AND gate 15 is opened by the Q output "1" of the flip-flop 28.

The final sound of the ordinary pattern in the one measure is soon generated, and when the value of the counter 12 becomes 7, the carry output "1" is applied through the AND gate 15 opened as described above and the OR gate 15 to the flip-flop 26, and sets the flip-flop 26 as shown in FIG. 8. A "1" is inputted to the terminal $I_0$ of the rhythm pattern selector 35 in the same manner as described above, the ordinary pattern is switched to the ending pattern, and the flip-flop 28 is reset. Thus, when the ending switch 30 is closed after the third time of the ordinary pattern, the ordinary pattern is switched to the ending pattern after the final sound has been generated in the measure of the ordinary pattern, and the number of times of the performance of the ending pattern can accordingly be prevented from being reduced.

In this manner, when the data of the address 4 of the ending pattern is read out, the end code detector 40 produces an output in the same manner as described above, the automatic accompaniment is finished while the last rest remains, and the automatic accompaniment can at once be started again as shown in FIG. 8.

In order to carry out the automatic accompaniment for the ordinary pattern and the ending pattern in the various rhythms other than the march, the rhythm pattern switch 36 is switched to the desired pattern, and is operated in the same manner as described above.

In the embodiments described above, the automatic ending accompaniment is performed for the accompaniment of the rhythm such as a march or a rock. However, the accompaniment may be also performed for the accompaniment for chords, bass or arpeggio, and they may also be combined in the accompaniment in the same manner as described above.

In the embodiments described above, the final sound data are read out areas of the ending pattern in the memory 17 of all "1". However, an area which stores only the final sound data may be separately provided in the memory 17.

According to the present invention as described above, since the automatic ending accompaniment has been finished irrespective of the remaining rests when predetermined data in the ending accompaniment data such as that representing a final sound is detected, the automatic accompaniment can be started again immediately without waiting for the rest time, and the performance may be rapidly shifted to the next accompaniment performance. For example, it is convenient if desired to repeatedly train the performance of a musical piece.

Still another embodiment of the present invention will now be described in detail with reference to FIGS. 9 to 12.

Figure 9:
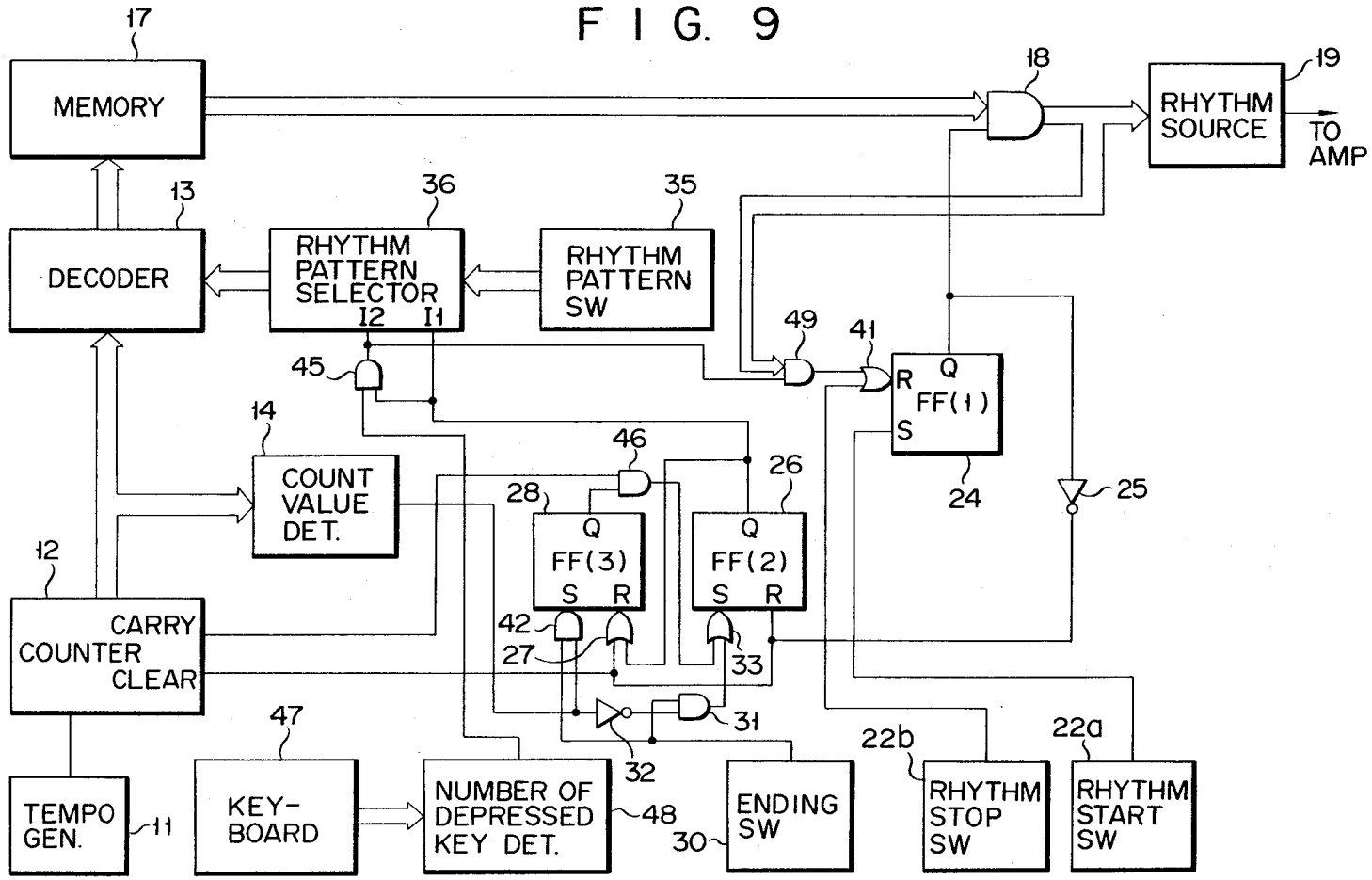
FIG. 9 is a block diagram showing still another embodiment of an electronic musical instrument according to the present invention.

In FIG. 9, a tempo generator 11 supplies a clock pulse capable of varying its oscillating frequency by a tempo control knob (not shown) to a counter 12. The counter 12 repeatedly counts in each measure, that is octal count value 0 to 7 on the basis of the clock pulse, and applies the count value to a decoder 13 and a count value detector 14.

A rhythm pattern selector 36 detects the ON operation of a rhythm pattern switch 35 capable of selecting and designating a rhythm such as a march, a rock or a waltz, and supplies the data to the decoder 13. The selector 36 supplies the ending switching data or the end switching data to the decoder 13 when "1" ("high" state of binary logic levels) is applied to the terminals $I_1$ or $I_2$.

The decoder 13 designates the address of 0 to 7 for the ordinary pattern or the ending pattern such as a march or a rock stored in a memory 17 on the basis of the count value from the counter 12, and switches the designating address of various rhythms for a march or a rock as well as the designating address of the ordinary pattern, the ending pattern or the final pattern on the basis of the data from the selector 36.

The case that the contents of the memory 17 are the ordinary pattern, the ending pattern and the final pattern of the march, as an example, will be described with reference to FIGS. 11A, 11B and 11C. A "0" which indicates non sound production ("low state" of binary logic levels) or "1" which indicates a sound production ("high state" of binary logic levels) is stored in each of areas designated for a cymbal (CY), a high hat (HH), a snare drum (SD) and a bass drum (BD) corresponding to each address of 0 to 7. The respective rhythm pattern data from the cymbal to the bass drum can be read out in parallel by addressing by the decoder 13.

Figures 10, 11A, 11B, 11C:
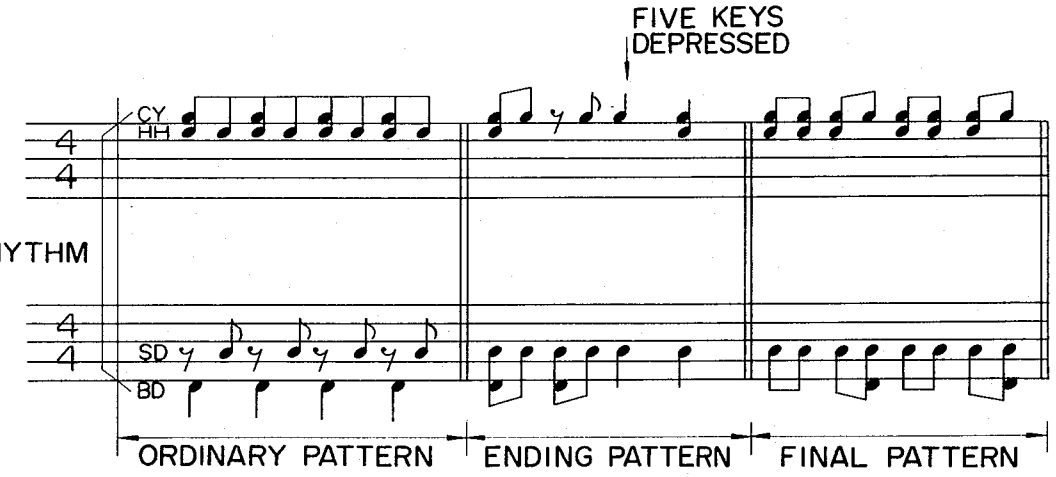
FIG. 10 is a view showing part of a music score for describing the operation of the embodiment in FIG. 9.
FIG. 11A, FIG. 11B and FIG. 11C are respectively views showing the contents of rhythm pattern data stored in a memory in FIG. 9.

The pattern data of various rhythms which is respectively read out from the memory 17 is inputted through an AND gate 18 to a rhythm source 19, which can, in turn, generate rhythm sound signals of four types from the above-described cymbal to the bass drum, which are then supplied through an amplifier to a loudspeaker (not shown) for sounding in the pattern shown in FIG. 10.

A rhythm start switch **22*a* serves to produce a one pulse "1" to the S (set) terminal of a flip-flop 24 by the ON operation. A rhythm stop switch 22*b* serves to produce one pulse "1" to the R (reset) terminal of the flip-flop 24 by the ON operation. The flip-flop 24 applies its output Q to the AND gate 18 to control the opening or closing of the AND gate 18, and further applies the output Q through an inverter 25 to the R terminal of a flip-flop 26 and to the R terminal of a flip-flop 28 through an OR gate 27 and to the clear terminal of the counter 12**.

An ending switch 38 produces one pulse "1" to AND gates 31, 42 by the ON operation. To the AND gate 42 is also applied an output from the count value detector 14 as it is, and to the AND gate 31 is applied an output from the count value detector 14 through an inverter 32. The detector 14 produces an output when the count value supplied from the counter 12 becomes higher than "4" to control closing of the AND gates 31, 42.

The output of the AND gate 31 is, in turn, supplied through an OR gate 33 to the S terminal of the flip-flop 26. The Q output of the flip-flop 26 is applied to the terminal $I_1$ of the above-described rhythm pattern selector 36, which controls switching to the ending pattern, and is also applied to the AND gate 45, and to the R terminal of the flip-flop 28 through the OR gate 27.

The output of the AND gate 42 is applied to the S terminal of the flip-flop 28, the output Q of the flip-flop 28 is applied to the AND gate 46. The carry output of the counter 12 is applied to the AND gate 46, the output of the AND gate 46 is applied to the S terminal of the flip-flop 26 through the OR gate 33 to control or switch the flip-flop 26.

The output of a key depression number detector 48 which detects the number of keys depressed simultaneously of a keyboard 47, and produces an output when the number becomes 5 or higher, is applied to the AND gate 45, the output of the AND gate 45 is applied to the terminal $I_2$ of the above-described rhythm pattern selector 36 to control or switch to the end pattern, and to the AND gate 49. To the AND gate 49 is applied the output of the AND gate 18, and the output of the AND gate 49 is applied to the R terminal of the flip-flop 24 through the OR gate 41.

An operation of the embodiment constructed as described above will now be described.

When a power source switch (not shown) is first turned ON and a suitable tempo is selected by the tempo control knob (not shown), the tempo generator 11 is activated.

Figure 12:
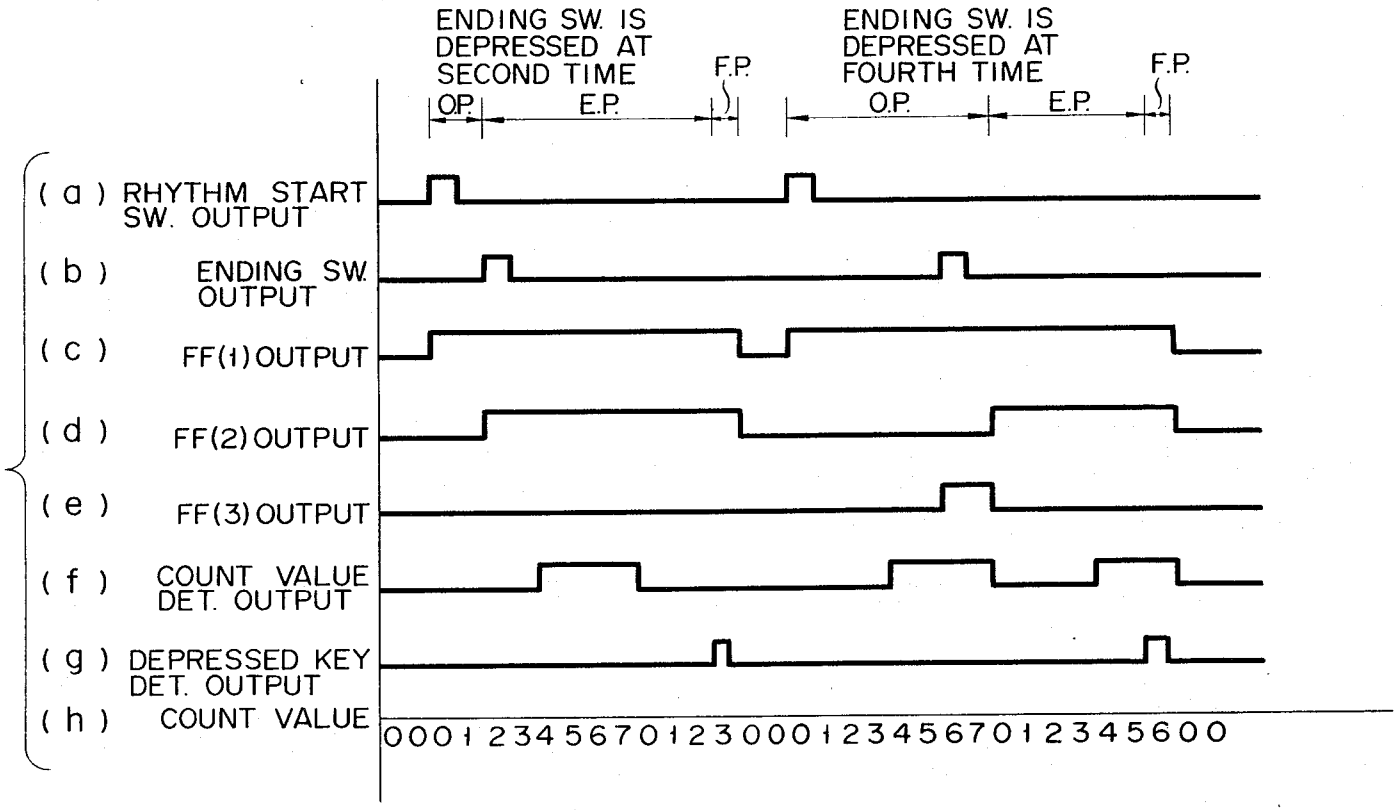
FIG. 12 is a time chart for describing the operation of the embodiment in FIG. 9.

When the rhythm start switch 22*a* is then turned ON, the flip-flop 24 is set as shown in FIG. 12, the AND gate 18 is opened by the Q output "1", the reset states of the flip-flops 26, 28 are released through the inverter 25, and the clear state of the counter 12 is released.

Then, the counter 12 is driven by the clock pulse from the tempo generator 11, and the count values 0 to 7 are sequentially supplied to the decoder 13. If the rhythm of march is selected by the rhythm pattern switch 35, the ON operation is detected by the selector 36, and the data is applied to the decoder 13. Since the flip-flop 26 is reset, "0" is applied to the terminals $I_1$, $I_2$ of the rhythm pattern selector 36, and the data of the ordinary pattern designation is applied to the decoder 13.

Thus, the decoder 13 addresses the ordinary pattern section of the march in the memory 17 on the basis of the data and the count value, sequentially reads out the rhythm pattern of the addresses from 0 to 7, which are, in turn, inputted to the rhythm source 19 through the AND gate 18 opened as described above, and the rhythm sound of the pattern shown in FIG. 10 is sequentially produced and generated and repeated in every one measure.

Assume now that the ending switch 30 is operated at the second time between the first time and the second and one-half time as designated in FIG. 10. Since the count value of the count 12 is "2" at this time, the count value detector 14 does not produce an output "1", and the AND gate 42 remains closed, and the AND gate 31 is opened. Accordingly, one pulse "1" from the detector 30 is inputted through the AND gate 31 and the OR gate 33 to set the flip-flop 26, as shown in FIG. 12.

Then, the Q output "1" of the flip-flop 26 is inputted to the terminal $I_1$ of the rhythm pattern selector 36, the ending switching data is applied from the selector 36 to the decoder 13, the addressing of the memory 17 by the decoder 13 is switched, the ending pattern in FIG. 10 is read out to immediately switch the rhythm sound from the ordinary pattern to the ending pattern, and the AND gate 45 is opened by the Q output "1".

In this case, since the counter 12 counts the count value 2 and subsequently counts "3, 4, . . . " to continue counting, the decoder 13 addresses in the memory section of the ordinary pattern of the memory 17 to 0 and 1, and then advances to the ending pattern to 2, 3, 4, . . . and performs the ending pattern.

After the ending pattern is performed to the last rhythm sound of the measure, sounding is progressed to the second and one-half time counted from the head of the measure. At this time, a player simultaneously depresses five or more keys in the keyboard 47 and the end of the performance is instructed. Since five or more keys are frequently depressed at the ending time of an accompaniment, the five keys are used as reference in this embodiment. Thus, the detection output "1" is applied to the terminal $I_2$ of the rhythm pattern selector 36 through the AND gate 45 opened as described above, and the AND gate 49 is opened. Then, the final switching data is applied from the the selector 36 to the decoder 13 to switch the address for the memory 17 by the decoder 13, the decoder 13 reads out the final pattern data shown in FIG. 10, delivers the pattern data through the AND gate 18 to the rhythm source 19, and the rhythm sounds are immediately switched from the ending pattern to the final pattern.

The output of the AND gate 18 resets the flip-flop 24 through the AND gate 49 opened as described above and the OR gate 41. Then, the AND gate 18 is closed, the final pattern is merely irradiated, and the automatic rhythm accompaniment is finished. Simultaneously, since the output of the inverter 25 becomes "1", the flip-flops 26, 28 are reset, and the counter 12 is cleared.

In this manner, the automatic ending accompaniment is automatically finished to match to the finishing operation of the player.

Assume now that the ending switch 30 is operated at the fourth time after the third time of the ordinary pattern while the rhythm sound of the ordinary pattern is being produced. The count value of the counter 12 is "6" at this time, the count value detector 14 produces an output as shown in FIG. 12, and the AND gate 42 is opened. One pulse "1" from the ending switch 30 sets the flip-flop 28 through the AND gate 42 as shown in FIG. 12, and the AND gate 46 is opened by the Q output "1".

Then, the pattern in one measure of the ordinary pattern is soon completely generated soon. When the count value of the counter 12 becomes 7, the carry output "1" is applied through the AND gate 46 opened as described above and the OR gate 33 to the flip-flop 26, to set the flip-flop 26, as shown in FIG. 12. Then, "1" is inputted to the terminal $I_1$ of the rhythm pattern selector 36 in the same manner as described above to switch the ordinary pattern to the ending pattern, the AND gate 45 is opened, and the flip-flop 28 is reset. In this manner, when the ending switch 30 is turned ON after the third time of the ordinary pattern, the final sound is generated in the measure of the ordinary pattern, and the ordinary pattern is then switched to the ending pattern, thus the number of times of the ending pattern can be prevented from being reduced.

When depression of keys more than five keys is carried out as the end of the performance at the fourth time of the ending pattern this time, one rhythm sound of the address 6 in the end pattern is generated in the same manner as described above, and the automatic rhythm accompaniment is finished.

In order to carry out the automatic accompaniment for the ordinary pattern, the ending pattern and the final pattern in the various rhythms other than the march, the rhythm pattern switch 35 is switched to the desired pattern, and is operated in the same manner as described above.

In the embodiments described above, the automatic ending accompaniment is finished for the accompaniment of the rhythm such as a march or a rock. However, the accompaniment may be also finished for the accompaniment for chords, bass or arpeggio, and they may also be combined in the accompaniment in the same manner as described above.

According to the present invention as described above, since the automatic ending accompaniment has been finished in response to the depression of more than a predetermined number of keys to obtain the end of the performance, a player does not need to finish the performance by matching to the automatic ending accompaniment, and even a beginner can conveniently play a melody performance, for example.

What is claimed is:

1. An electronic musical instrument with an automatic accompaniment function, comprising:

automatic accompaniment pattern generating means for selectively generating an automatic accompaniment pattern data;

control means for outputting an instruction signal for the execution of said automatic accompaniment, said control means comprising an ending switch and means for outputting an ending instruction signal for the execution of an automatic ending accompaniment according to the operation of said ending switch;

sound generating means for generating accompaniment sounds according to the selected automatic accompaniment pattern data;

said automatic accompaniment pattern generating means including means for generating automatic ending accompaniment pattern data in response to said ending instruction signal; and terminating means coupled to said sound generating means for terminating the automatic ending accompaniment of said sound generating means, said terminating means including detecting means for detecting a condition that a final sound of the ending accompaniment pattern is generated, and means coupled to said detecting means for terminating the automatic ending accompaniment responsive to said detecting means detecting said condition, and for automatically disabling said sound generating means.

2. The electronic musical instrument of claim 1, wherein said automatic accompaniment pattern generating means comprises:

tempo setting means for setting the tempo of an accompaniment to be performed;

ordinary automatic accompaniment pattern selecting means for selecting an ordinary automatic accompaniment pattern; and producing means for producing data corresponding to the selected ordinary automatic accompaniment pattern on the basis of the output of said ordinary automatic accompaniment pattern selecting means and the set tempo, thereby generating an ordinary accompaniment sound on the basis of the accompaniment pettern data thus produced.

3. The electronic musical instrument of claim 2, wherein said tempo setting means comprises a tempo generator; and a tempo counter for counting the output of said tempo generator.

4. The electronic musical instrument of claim 3, wherein said ordinary automatic accompaniment pattern selecting means comprises a rhythm pattern switch; and a selector for outputting a predetermined rhythm pattern selection output in response to an output of said rhythm pattern switch.

5. The electronic musical instrument of claim 4, wherein said producing means comprises means for outputting a first memory address signal on the basis of the output of said tempo counter and the output of said selector; and first memory means for outputting accompaniment pattern data stored therein and accessed by said first memory address signal.

6. The electronic musical instrument of claim 5, wherein said control means comprises means for generating an ending signal in response to the operation of said ending switch; and gate means to which the ending signal thus generated is supplied.

7. The electronic musical instrument of claim 6, wherein said control means further comprises counted value detecting means for detecting the count value of said tempo counter; and means for opening said gate means by the carry output of said tempo counter and the output of said detecting means when the count value is lower than a predetermined value.

8. The electronic musical instrument of claim 7, wherein said automatic accompaniment pattern generating means comprises:

means for generating an ending instruction signal in response to the output of said gate means;

means for outputting a second memory address signal on the basis of the ending instruction signal and the output of said tempo counter; and second memory means for outputting the ending accompaniment pattern data accessed by said second memory address signal, thereby generating an ending accompaniment sound on the basis of the ending accompaniment pattern data thus obtained.

9. The electronic musical instrument of claim 8, wherein said first memory means comprises a ROM having a first memory section accessed by said first memory address signal; and said second memory means comprises a second memory section of said ROM and which is accessed by said second memory address signal.

10. The electronic musical instrument of claim 8, wherein said tempo counter is an octal counter; said counted value detecting means outputs an output "1" when the count value of said tempo counter becomes "5" or higher; and said gate means is closed by said output "1" of said counted value detecting means.

11. The electronic musical instrument of claim 8, further comprising rhythm start/stop control means for controlling the supply of the outputs of said first and second memory means to said sound generating means.

12. An electronic musical instrument with an automatic accompaniment function, comprising:

automatic accompaniment pattern generating means for selectively generating an automatic accompaniment pattern data;

control means for outputting an instruction signal for the execution of said automatic accompaniment, said control means comprising an ending switch and means for outputting an ending instruction signal for the execution of an automatic ending accompaniment according to the operation of said ending switch;

sound generating means for generating accompaniment sounds according to the selected automatic accompaniment pattern data;

said automatic accompaniment pattern generating means including means for generating automatic ending accompaniment pattern data in response to said ending instruction signal; and terminating means coupled to said sound generating means for terminating the automatic ending accompaniment of said sound generating means, said terminating means including detecting means for detecting a predetermined data in the automatic ending accompaniment pattern data which is generated by said automatic accompaniment pattern generating means, and means coupled to said detecting means for terminating the automatic ending accompaniment responsive to said detecting means detecting said predetermined data, and for automatically disabling said sound generating means.

13. The electronic musical instrument of claim 12, wherein said detecting means includes means for detecting a final code contained in the outputted ending accompaniment pattern data; and further comprising means for preventing the supply of the ending accompaniment pattern data to said sound generating means as a function of the output of said detecting means.

14. The electronic musical instrument of claim 12, wherein said automatic accompaniment pattern generating means comprises:

tempo setting means for setting the tempo of an accompaniment to be performed;

ordinary automatic accompaniment pattern selecting means for selecting an ordinary automatic accompaniment pattern; and producing means for producing data corresponding to the selected ordinary automatic accompaniment pattern on the basis of the output of said ordinary automatic accompaniment pattern selecting means and the set tempo, thereby generating an ordinary accompaniment sound on the basis of the accompaniment pattern data thus produced.

15. The electronic musical instrument of claim 14, wherein said tempo setting means comprises a tempo generator; and a tempo counter for counting the output of said tempo generator.

16. The electronic musical instrument of claim 15, wherein said ordinary automatic accompaniment pattern selecting means comprises a rhythm pattern switch; and a selector for outputting a predetermined rhythm pattern selection output in response to an output of said rhythm pattern switch.

17. The electronic musical instrument of claim 16, wherein said producing means comprises means for outputting a first memory address signal on the basis of the output of said tempo counter and the output of said selector; and first memory means for outputting accompaniment pattern data stored therein and accessed by said first memory address signal.

18. The electronic musical instrument of claim 17, wherein said control means comprises means for generating an ending signal in response to the operation of said ending switch; and gate means to which the ending signal thus generated is supplied.

19. The electronic musical instrument of claim 18, wherein said control means further comprises counted value detecting means for detecting the count value of said tempo counter; and means for opening said gate means by a carry output of said tempo counter and the output of said detecting means when the count value is lower than a predetermined value.

20. The electronic musical instrument of claim 19, wherein said automatic accompaniment pattern generating means comprises:

means for generating an ending instruction signal in response to the output of said gate means;

means for outputting a second memory address signal on the basis of the ending instruction signal and the output of said tempo counter; and second memory means for outputting the ending accompaniment pattern data accessed by said second memory address signal, thereby generating an ending accompaniment sound on the basis of the ending accompaniment pattern data thus obtained.

21. The electronic musical instrument of claim 20, wherein said first memory means comprises a ROM having a first memory section accessed by said first memory address signal; and said second memory means comprises a second memory section of said ROM and which is accessed by said second memory address signal.

22. The electronic musical instrument of claim 20, wherein said tempo counter is an octal counter; said counted value detecting means outputs an output "1" when the count value of said tempo counter becomes "5" or higher; and said gate means is closed by said output "1" of said counted value detecting means.

23. The electronic musical instrument of claim 20, further comprising rhythm start/stop control means for controlling the supply of the outputs of said first and second memory means to said sound generating means.

24. An electronic musical instrument with an automatic accompaniment function, comprising:

automatic accompaniment pattern generating means for selectively generating an automatic accompaniment pattern data;

control means for outputting an instruction signal for the execution of said automatic accompaniment, said control means comprising an ending switch and means for outputting an ending instruction signal for the execution of an automatic ending accompaniment according to the operation of said ending switch;

sound generating means for generating accompaniment sounds according to the selected automatic accompaniment pattern data;

said automatic accompaniment pattern generating means including means for generating automatic ending accompaniment pattern data in response in said ending instruction signal;

a keyboard having a plurality of manually operable keys for manual performance; and terminating means coupled to said sound generating means for terminating the automatic ending accompaniment of said sound generating means, said terminating means including detecting means for detecting the number of simultaneously depressed keys on said keyboard, and means coupled to said detecting means for terminating the automatic ending accompaniment when the detected number of simultaneously depressed keys exceeds a predetermined number.

25. The electronic musical instrument of claim 24, wherein said automatic accompaniment pattern generating means comprises:

tempo setting means for setting the tempo of an accompaniment to be performed;

ordinary automatic accompaniment pattern selecting means for selecting an ordinary automatic accompaniment pattern; and producing means for producing data corresponding to the selected ordinary automatic accompaniment pattern on the basis of the output of said ordinary automatic accompaniment pattern selecting means and the set tempo, thereby generating an ordinary accompaniment sound on the basis of the accompaniment pattern data thus produced.

26. The electronic musical instrument of claim 25, wherein said tempo setting means comprises a tempo generator; and a tempo counter for counting the output of said tempo generator.

27. The electronic musical instrument of claim 26, wherein said ordinary automatic accompaniment pattern selecting means comprises a rhythm pattern switch; and a selector for outputting a predetermined rhythm pattern selection output in response to an output of said rhythm pattern switch.

28. The electronic musical instrument of claim 27, wherein said producing means comprises means for outputting a first memory address signal on the basis of the output of said tempo counter and the output of said selector; and first memory means for outputting accompaniment pattern data stored therein and accessed by said first memory address signal.

29. The electronic musical instrument of claim 28, wherein said control means comprises means for generating an ending signal in response to the operation of said ending switch; and gate means to which the ending signal thus generated is supplied.

30. The electronic musical instrument of claim 29, wherein said control means further comprises counted value detecting means for detecting the count value of said tempo counter; and means for opening said gate means by a carry output of said tempo counter and the output of said detecting means when the count value is lower than a predetermined value.

31. The electronic musical instrument of claim 30, wherein said automatic accompaniment pattern generating means comprises:

means for generating an ending instruction signal in response to the output of said gate means;

means for outputting a second memory address signal on the basis of the ending instruction signal and the output of said tempo counter; and second memory means for outputting the ending accompaniment pattern data accessed by said second memory address signal, thereby generating an ending accompaniment sound on the basis of the ending accompaniment pattern data thus obtained.

32. The electronic musical instrument of claim 31, wherein said first memory means comprises a ROM having a first memory section accessed by said first memory address signal; and said second memory means comprises a second memory section of said ROM and which is accessed by said second memory address signal.

33. The electronic musical instrument of claim 31, wherein said tempo counter is an octal counter; said counted value detecting means outputs an output "1" when the count value of said tempo counter becomes "5" or higher; and said gate means is closed by said output "1" of said counted value detecting means.

34. The electronic musical instrument of claim 31, further comprising rhythm start/stop control means for controlling the supply of the outputs of said first and second memory means to said sound generating means.

* * * * *